US006244468B1

(12) United States Patent
Farmer et al.

(10) Patent No.: US 6,244,468 B1
(45) Date of Patent: Jun. 12, 2001

(54) SELF-SEALING VALVE AND SACHET FOR DISPENSING LIQUIDS

(76) Inventors: Harley Farmer, 47 Common Lane, Hemingford Abbots, Cambridgeshire PE18 9AW; Michael W Prust, Meadowview Cottage, Mildenhall Road, Worlington, Suffolk IP28 8RY, both of (GB)

( * ) Notice: Subject to any disclaimer, the term of this patent is extended or adjusted under 35 U.S.C. 154(b) by 0 days.

(21) Appl. No.: 09/462,711

(22) PCT Filed: Jul. 6, 1998

(86) PCT No.: PCT/GB98/01985

§ 371 Date: Jan. 12, 2000

§ 102(e) Date: Jan. 12, 2000

(87) PCT Pub. No.: WO99/03391

PCT Pub. Date: Jan. 28, 1999

(30) Foreign Application Priority Data

Jul. 17, 1997 (GB) ..... 9715008

(51) Int. Cl.[7] ..... B65D 35/08
(52) U.S. Cl. ..... 222/107; 222/212; 222/494
(58) Field of Search ..... 222/92, 95, 105, 222/107, 212, 191, 494

(56) References Cited

U.S. PATENT DOCUMENTS 2,904,225 * 9/1959 Earles, Jr. ..... 222/212 X
3,278,085 * 10/1966 Brown ..... 222/107
3,315,849 * 4/1967 Herzig ..... 222/491
3,635,376 * 1/1972 Hellstrom ..... 222/107
3,815,794 * 6/1974 Carlisle ..... 222/491
3,878,977 * 4/1975 Carlisle ..... 222/491
4,163,509 * 8/1979 Amneus ..... 222/95
4,252,257 * 2/1981 Herzig ..... 222/491 X
4,564,127 1/1986 Garabedian et al. .
5,067,635 * 11/1991 Thomsen ..... 222/105 X
5,207,355 5/1993 Thomsen .

FOREIGN PATENT DOCUMENTS 0329532 8/1989 (EP) .
1196939 11/1959 (FR) .
1463579 2/1977 (GB) .

* cited by examiner

*Primary Examiner*—Kenneth Bomberg
(74) *Attorney, Agent, or Firm*—Selitto, Behr & Kim

(57) ABSTRACT

A self-sealing valve (2) for a liquid dispenser, comprising an envelope (3) of flexible sheet material having opposed inlet and outlet portions and an intermediate portion (6) between the inlet and outlet portions, which intermediate portion (6) comprises a spaced pair of transverse folds (4, 5) in the envelope (3) to restrict or prevent flow of fluent material, e.g., liquid, between the inlet and outlet portions, the arrangement being such that fluent material flow across the intermediate portion (6) can be induced by distortion of the intermediate portion (6), e.g., the application of pressure to the envelope (3) upstream of the intermediate portion, thus causing the seal created by the transverse folds (4, 5) to open to allow the material to pass. A liquids dispensing sachet (1) having a self sealing valve (2) as described above and a wall mounted dispenser (17) for liquids including such a sachet.

30 Claims, 3 Drawing Sheets

SELF-SEALING VALVE AND SACHET FOR DISPENSING LIQUIDS

TECHNICAL FIELD

The invention relates to valve means, and more particularly, but not exclusively, to valve means for use in dispensing liquids from containers and to dispensers comprising such valve means.

BACKGROUND ART

Liquid dispensers are known for dispensing liquid soap in washrooms and which consist of a wall-mounted device comprising a container for liquid soap and a hand operated plunger for dispensing shots or doses of the soap. Such devices are complicated, are comparatively expensive, are difficult to recycle because of the numerous materials used in each unit and are difficult to clean.

GB-A-1 463 579 and FR-A-1 196 939 both disclose a container for dispensing liquids having a valve means comprising an envelope of flexible sheet material having opposed inlet and outlet portions and an intermediate portion between the inlet and outlet portions, which intermediate portion comprises a transverse fold in the envelope to restrict or prevent flow of liquid between the inlet and outlet portions, the arrangement being such that liquid flow across the intermediate portion can be induced by distortion of the latter.

DISCLOSURE OF INVENTION

It is an object of the invention to provide a simple self-sealing valve, e.g. for a liquids dispenser.

It is among the objects of the invention to provide a washroom dispenser, e.g. for soap or hand cleanser or the like, which is simple in construction and which is hygienic.

It is also among the objects of the invention to provide a disposable liquid container having integral dispensing means.

It is another object of the invention to provide a liquids dispenser of flexible plastics sheet, which is readily recyclable.

From one aspect the invention is valve means comprising an envelope of flexible sheet material having opposed inlet and outlet portions and an intermediate portion between the inlet and outlet portions, which intermediate portion comprises a transverse fold in the envelope to restrict or prevent flow of liquid between the inlet and outlet portions, the inlet/outlet/intermediate portion arrangement being such that liquid flow across the intermediate portion can be induced by distortion of the intermediate portion, e.g. the application of pressure to the envelope upstream of the outlet portion, thus causing the seal created by the transverse fold to open to allow the material to pass, characterised in that the intermediate portion comprises a spaced pair of transverse folds, each fold thus creating an openable seal.

The spaced pair of folds may define a Z-shaped formation in the envelope. The downstream fold may comprise flow restricting means, e.g. a nozzle. The envelope may be made from plastics sheet, and the flow restricting means may comprise a permanent seal, e.g. a heat seal or weld extending transversely of the envelope. The flow restricting means may comprise a pair of converging seals which form a nozzle portion between them. The seal or pair of seals may also be arranged to hold the fold(s) in the envelope.

An intermediate chamber may be formed upstream of the inlet portion, e.g. to form dose regulating means. The intermediate chamber may be formed by one or more seals across the envelope to define a liquid inlet into the intermediate chamber. The arrangement. may be such that the liquid inlet into the intermediate chamber can be closed, e.g. by manual pressure applied by the user to the exterior of the envelope, after which the user can apply pressure to the intermediate chamber to evacuate the contents. via the outlet, in a process akin to milking a cow.

The envelope may be tubular. The envelope may comprise a sachet for containing the fluent material, e.g. liquid to be dispensed. The valve means may be disposed in a dispensing section of the sachet, which dispensing section may be formed as a manually graspable teat.

Thus from another aspect the invention is a dispenser for liquids comprising valve means as described above.

From yet another aspect the invention is a dispenser for liquids comprising a sachet as described above.

The sachet may be arranged for personal use, e.g. for fixing to the user's clothing or may be arranged for fixing to a wall or the like mounted dispenser. The sachet may be provided with eyelets in a marginal flange for mounting on supporting pegs on the dispenser or other fixing device.

BRIEF DESCRIPTION OF DRAWINGS

The invention is diagrammatically illustrated, by way of example, in the accompanying drawings, in which.

BEST MODES FOR CARRYING OUT THE INVENTION

Figure 1:
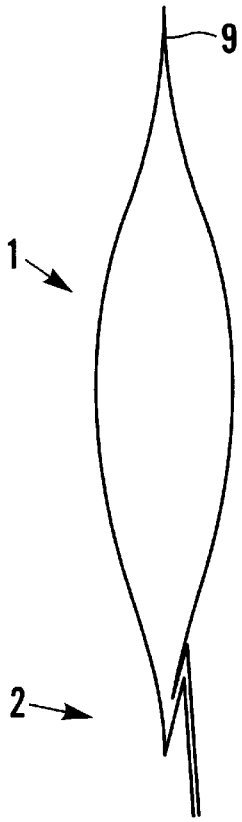
FIG. 1 is a sectional side view of a liquid containing sachet including a dispensing valve outlet in accordance with the invention.
Figure 2:
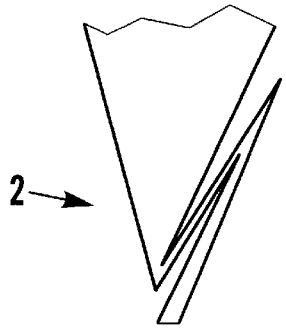
FIG. 2 is an enlarged scrap sectional side view of the dispensing valve outlet of FIG. 1.

Referring to the drawings, and more particularly to FIGS. 1 to 4 thereof, there is shown a sachet (1) made of plastics film, which sachet is intended to contain liquid which can be dispensed through a dispensing valve outlet (2) formed at the bottom of the sachet as seen in FIG. 1.

Figure 3:
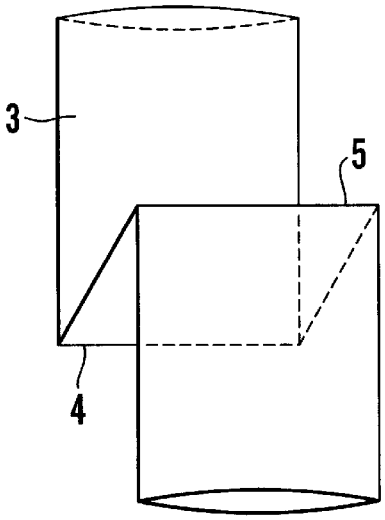
FIG. 3 is a perspective view of a portion of tubular envelope used to form the sachet of FIG. 1 and showing a step in the formation of the dispensing valve outlet.
Figure 4:
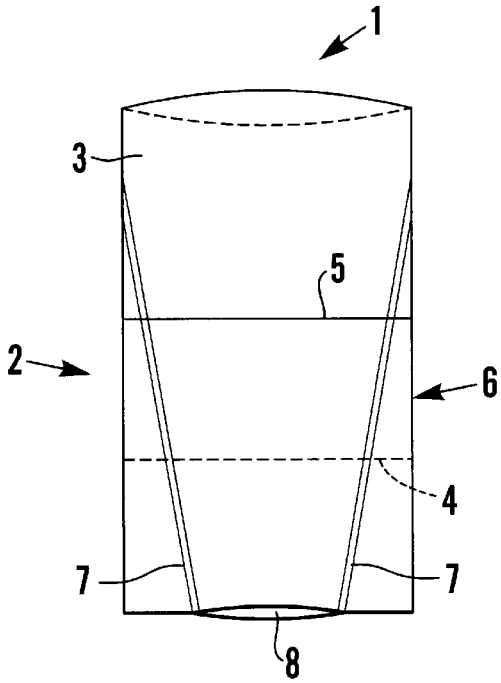
FIG. 4 is a front view of the portion of tubular envelope shown in FIG. 3 and showing a further step in the formation of the dispensing valve outlet.

The sachet of FIG. 1 is made from a length of a tubular plastics film (3) and the dispensing valve outlet (2) is made by folding a lower portion of the tubular film as indicated in FIG. 3 of the drawings to form a pair of folds (4, 5) of substantially Z formation and securing the folded portion (6)

thus created against the sachet to hold the folds (4, 5) in position. This may be achieved as shown in FIG. 4 with the aid of heat seals or welds (7) which m ay, if desired, converge to define a n outlet nozzle (8) as shown in FIG. 4. The folded portion (6) thus forms an intermediate portion defined by the folds, (4, 5) and which together form a valve with the fold (4) lying upstream and defining an inlet and the fold (5) lying downstream and defining an outlet.

After filling of the sachet with a liquid to be dispensed, the upper end (9) of the sachet will be closed, e.g. with a heat seal or the like to form the sachet (1). The pair of folds (4, 5) created at the base of the sachet prevent liquid from flowing from the sachet until pressure is applied to the sachet to distort the folded portion of the sachet to allow liquid to flow while the pressure is maintained.

Figure 5:
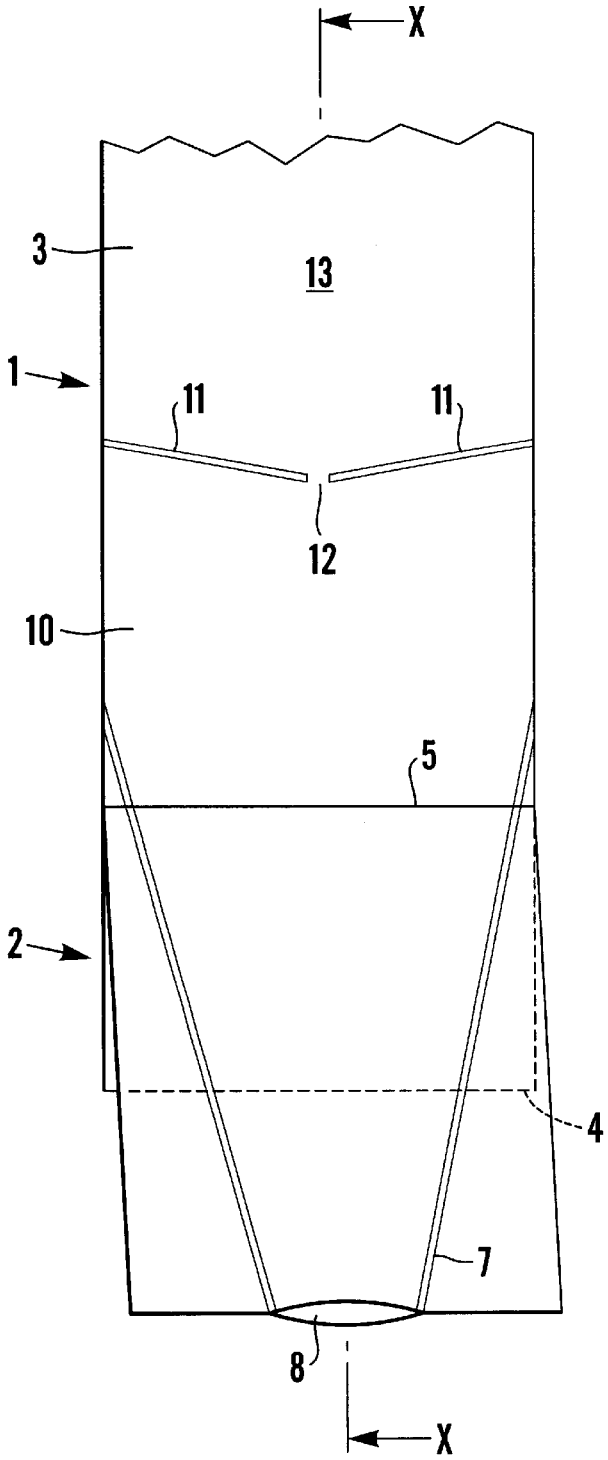
FIG. 5 is a front view similar to that of FIG. 4 and showing a modified form of sachet.
Figure 6:
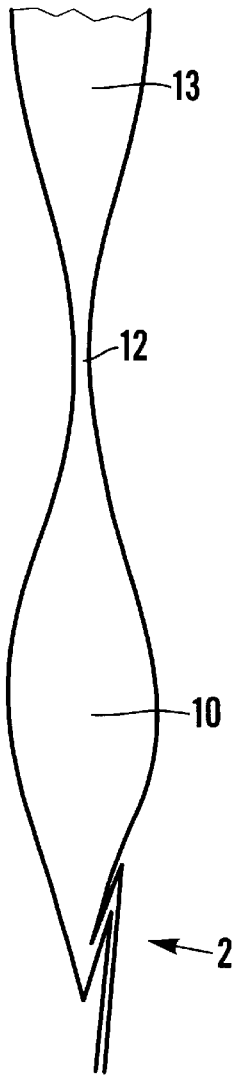
FIG. 6 is a sectional view taken on the line X—X of FIG. 5.

FIGS. 5 and 6 illustrate a modified form of sachet (1) which comprises a sub-compartment (10) adjacent to the dispensing liquid outlet (2) and formed by one or more seals, e.g. heat seals, extending across the tubular envelope forming the sachet. In the drawings a pair of seals (11) are shown which extend from opposite sides of the sachet and which define between them a small opening (12) communicating between a main sachet cavity (13) and the small sub-compartment (10). Thus the sachet may be used to dispense a measured quantity of liquid contained in the sub-compartment (10). This can be achieved by closing the opening (12) between the pair of seals (11), e.g. by manually applied pressure and then squeezing the sub-compartment to evacuate its contents through the dispensing valve outlet (2).

Figure 7:
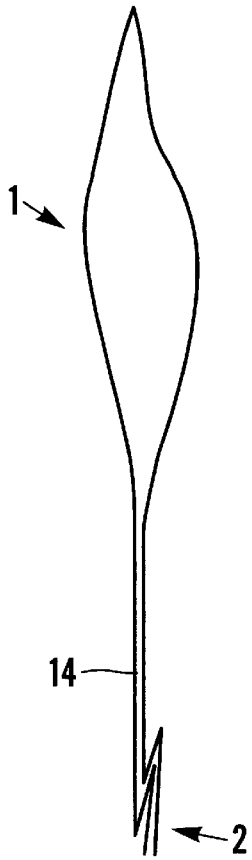
FIG. 7 is a sectional side view similar to that of FIG. 1 showing a modified sachet having an extended dispensing outlet section formed as a teat.
Figure 8:
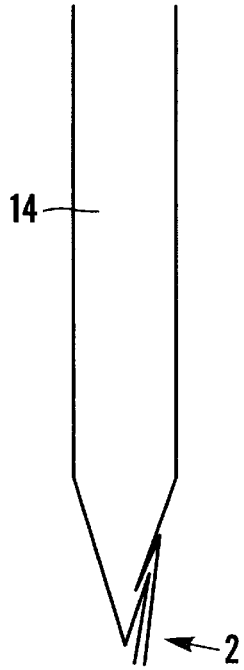
FIG. 8 is an enlarged scrap sectional side view showing the teat portion of the dispenser of FIG. 7.

FIG. 7 illustrates a modified form of sachet (1) in which the lower portion of the sachet is extended to form a teat (14) which is illustrated enlarged in FIG. 8 of the drawings.

Figure 9:
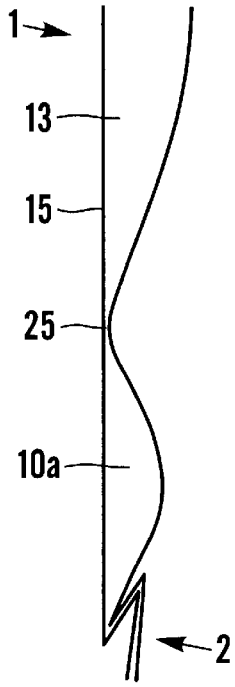
FIGS. 9 and 10 illustrate steps in dispensing liquid from a device of the general kind shown in FIGS. 7 and 8.
Figure 10:
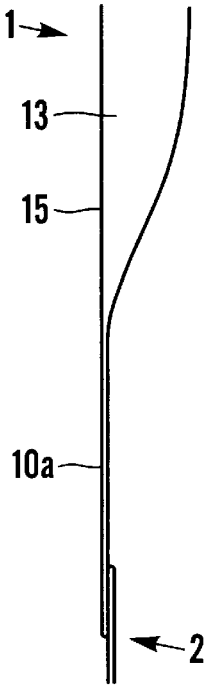

FIGS. 9 and 10 correspond generally to the arrangement of FIGS. 7 and 8 above, and show the effect of a sachet supported against a hard surface, e.g. a wall (not shown), so that it is flattened on one side (15). FIG. 9 shows the formation of an intermediate chamber (10*a*) similar to that of the embodiment of FIGS. 5 and 6 by the application of external pressure to the teat at a position indicated by reference 25, e.g. by the user, and FIG. 10 shows the intermediate chamber (10*a*) squeezed flat by the user to dispense its contents in a process similar to milking a cow.

Figure 11:
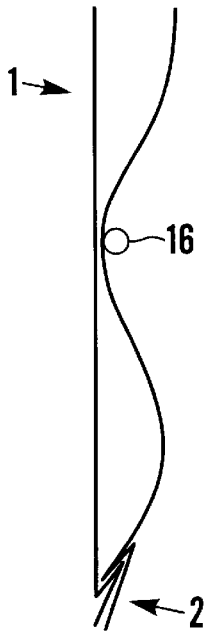
FIGS. 11 and 12 correspond to FIGS. 9 and 10 and illustrate dispensing steps using a movable clamp.
Figure 12:
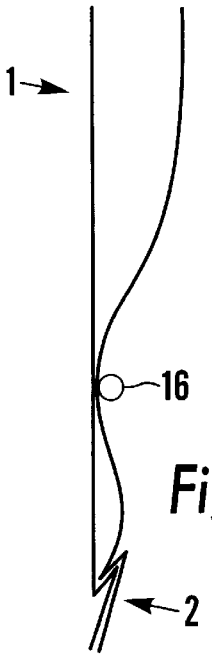

FIGS. 11 and 12 illustrate that the same effect as that achieved by the arrangement of FIGS. 9 and 10 may be achieved by use of a movable clamp (16) positioned over the teat portion of the sachet instead of by the use of manual manipulation as shown in FIGS. 5 and 6.

INDUSTRIAL APPLICATION

The invention thus provides a simple liquids dispensing sachet.

What is claimed is:

1. Valve means (2) comprising an envelope of flexible sheet material (3) having opposed inlet and outlet portions and an intermediate portion (6) between the inlet and outlet portions, which intermediate portion comprises a transverse fold seal in the envelope (3) to restrict or prevent flow of fluent material, between the inlet and outlet portions, the inlet/outlet/intermediate portion arrangement being such that fluent material flow across the intermediate portion can be induced by distortion of the intermediate portion, thus causing the seal created by the transverse fold to open to allow the material to pass, wherein the intermediate portion (6) comprises a spaced pair of transverse folds (4,5), each fold thus creating an openable seal.

2. Valve means according to claim 1, wherein said spaced pair of folds (4,5) define a Z-shaped formation in the envelope (3).

3. Valve means according to claim 1 wherein the envelope (3) is made from plastics film.

4. Valve means according to claim 1 wherein the downstream fold (5) comprises flow restricting means.

5. Valve means according to claim 4, wherein the flow restricting means comprises a permanent seal (7).

6. Valve means according to claim 5 wherein the seal or pair of seals (7) are arrangeable to hold folds (4,5) in the envelope (3).

7. Valve means according to claim 5 wherein the permanent seal (7) is a heat seal or weld extending transversely of the envelope (3).

8. Valve means according to claim 4 wherein the flow restricting means comprises a pair of converging seals (7) which form a nozzle portion (8) between them.

9. Valve means according to claim 1 wherein an intermediate chamber (10) is formed upstream of the outlet portion.

10. Valve means according to claim 9, wherein the intermediate chamber (10) is formed by at least one seal (11) across the envelope (3) to define a liquid inlet (12) into the intermediate chamber (10).

11. Valve means according to claim 10, wherein the intermediate chamber (10) is arranged such that the liquid inlet (12) into the intermediate chamber (10) is closable after which pressure is applicable to the intermediate chamber (10) to evacuate the contents via the outlet.

12. Valve means according to claim 11 wherein the intermediate chamber (10) is closable by manual pressure applied to the exterior of the envelope (3).

13. A sachet (1) for liquids comprising valve means (2) according to claim 1.

14. A sachet (1) according to claim 13, wherein the valve means (2) is disposed in a dispensing section of the sachet (1).

15. A sachet (1) according to claim 14, wherein the dispensing section is formed as a manually graspable teat (14).

16. A sachet (1) according to claim 15, wherein an intermediate chamber (10*a*) is formed upstream of the outlet portion by the application of external pressure, after which pressure is applicable to the intermediate chamber (10*a*) to evacuate its contents via outlet (2).

17. A sachet (1) according to claim 16, wherein the external pressure used to form intermediate chamber (10*a*) and to evacuate its contents is achieved by manual manipulation of teat (14).

18. A sachet (1) according to claim 16, wherein the external pressure used to form intermediate chamber (10*a*) and to evacuate its contents is achieved by manual manipulation of teat (14) by the use of a movable clamp (16) positioned over the teat (14).

19. A sachet (1) according to claim 15, wherein an intermediate chamber (10*a*) is formed upstream of the outlet portion for regulating dosage.

20. A dispenser for liquids comprising a sachet (1) according to claim 13.

21. A dispenser according to claim 20, wherein the sachet (1) is arranged for personal use.

22. A dispenser according to claim 21, wherein the sachet is provided with eyelets (22) in a marginal flange (23) for mounting on supporting pegs (19) on the dispenser or other fixing device.

23. A dispenser according to claim 20, wherein the sachet (1) is affixiable to a user's clothing.

24. A dispenser according to claim 20, wherein the sachet (1) is affixable to a wall mounted dispenser.

25. A dispenser for liquids comprising valve means (1) according to claim 1.

26. Valve means according to claim 1, wherein the fluent material is a liquid.

27. Valve means according to claim 1 wherein the restriction of flow is induced by the application of pressure to the envelope upstream of the outlet portion.

28. Valve means according to claim 1 wherein the envelope (3) is generally tubular in shape.

29. Valve means according to claim 1 wherein the envelope (3) comprises a sachet (1) for containing the fluent material.

30. Valve means according to claim 29, wherein said fluent material is a dispensable liquid.

* * * * *